US008992385B2

(12) United States Patent
Lemos

(10) Patent No.: US 8,992,385 B2
(45) Date of Patent: Mar. 31, 2015

(54) TENSION SYSTEMS AND METHODS OF USE

(75) Inventor: Robert F. Lemos, Escalon, CA (US)

(73) Assignee: Personal Trainer, Inc., Modesto, CA (US)

( * ) Notice: Subject to any disclaimer, the term of this patent is extended or adjusted under 35 U.S.C. 154(b) by 115 days.

(21) Appl. No.: 12/606,123

(22) Filed: Oct. 26, 2009

(65) Prior Publication Data

US 2011/0098155 A1 Apr. 28, 2011

(51) Int. Cl.

| | |
|---|---|
| ***A63B 21/005*** | (2006.01) |
| ***A63B 15/02*** | (2006.01) |
| ***A63B 71/00*** | (2006.01) |
| ***A63B 21/08*** | (2006.01) |
| ***A63B 21/078*** | (2006.01) |
| ***A63B 21/06*** | (2006.01) |
| ***A63B 21/062*** | (2006.01) |
| ***A63B 21/00*** | (2006.01) |
| ***A63B 23/12*** | (2006.01) |

(52) U.S. Cl.

CPC ..... *A63B 21/06* (2013.01); *A63B 21/062* (2013.01); *A63B 21/078* (2013.01); *A63B 21/151* (2013.01); *A63B 21/154* (2013.01); *A63B 21/159* (2013.01); *A63B 23/12* (2013.01); *A63B 2021/0626* (2013.01); *A63B 2021/0786* (2013.01)

USPC ..... 482/5; 482/1; 482/97; 482/104

(58) Field of Classification Search

USPC ..... 482/1, 5, 97, 92–94, 99, 114–116, 118, 482/120, 130, 133, 135, 148

See application file for complete search history.

(56) References Cited

U.S. PATENT DOCUMENTS

| | | | | |
|---|---|---|---|---|
| 3,573,865 | A * | 4/1971 | Annas et al. | 482/5 |
| 4,422,636 | A * | 12/1983 | de Angeli | 482/97 |
| 4,471,956 | A | 9/1984 | Marlo | |
| 4,620,703 | A * | 11/1986 | Greenhut | 482/4 |
| 4,650,185 | A * | 3/1987 | Cartwright | 482/97 |
| 4,763,897 | A | 8/1988 | Yakata | |
| 4,822,036 | A | 4/1989 | Dang | |
| 4,834,365 | A | 5/1989 | Jones | |
| 4,836,536 | A | 6/1989 | Jones | |
| 4,863,161 | A * | 9/1989 | Telle | 482/97 |
| 4,875,676 | A | 10/1989 | Zimmer | |
| 4,902,009 | A | 2/1990 | Jones | |
| 4,989,859 | A * | 2/1991 | Jones | 482/10 |

(Continued)

OTHER PUBLICATIONS

ISR from PCT/US2011/023883 dated Mar. 31, 2011.

(Continued)

*Primary Examiner* — Loan H Thanh
*Assistant Examiner* — Shila Jalalzadeh Abyane
(74) *Attorney, Agent, or Firm* — Mark D. Miller; William K. Nelson

(57) ABSTRACT

Machines, apparatuses, systems and methods for providing adjustable tension to a cable system using a pivotally mounted leverage mechanism that employs an adjustably positionable weight. Embodiments are used in exercise and other muscle strengthening devices, and may include an electronic control system for monitoring, recording a user's progress, and for altering or releasing tension to the cable system based on feedback from the user. Embodiments include a user interface for inputting information for particular exercises or workouts, as well as outputting/downloading information following exercises or workouts.

38 Claims, 12 Drawing Sheets

(56) References Cited

U.S. PATENT DOCUMENTS

| | | | | |
|---|---|---|---|---|
| 5,048,826 | A * | 9/1991 | Ryan | 482/7 |
| 5,102,121 | A * | 4/1992 | Solow et al. | 482/94 |
| 5,310,394 | A | 5/1994 | Kallios | |
| 5,314,394 | A | 5/1994 | Ronan | |
| 5,344,374 | A * | 9/1994 | Telle | 482/97 |
| 5,407,403 | A | 4/1995 | Coleman | |
| 5,722,921 | A * | 3/1998 | Simonson | 482/100 |
| 5,785,632 | A | 7/1998 | Greenberg et al. | |
| 5,993,356 | A | 11/1999 | Houston et al. | |
| 6,293,892 | B1 | 9/2001 | Slawinski et al. | |
| 6,379,287 | B1 | 4/2002 | Slawinski et al. | |
| 6,537,182 | B2 | 3/2003 | Slawinski et al. | |
| 6,558,299 | B1 | 5/2003 | Slattery | |
| 6,669,607 | B2 | 12/2003 | Slawinski et al. | |
| 6,749,538 | B2 | 6/2004 | Slawinski et al. | |
| 6,893,381 | B2 | 5/2005 | Slawinski | |
| 6,926,649 | B2 | 8/2005 | Slawinski | |
| 7,029,426 | B1 * | 4/2006 | Fuller, Sr. | 482/97 |
| 7,163,488 | B2 | 1/2007 | Anders et al. | |
| 7,278,958 | B2 * | 10/2007 | Morgan | 482/97 |
| 7,374,515 | B2 | 5/2008 | Slawinski et al. | |
| 7,527,568 | B2 * | 5/2009 | Joseph | 473/441 |
| 7,575,537 | B2 | 8/2009 | Ellis | |
| 7,591,771 | B2 | 9/2009 | Rullestad | |
| 2005/0233871 | A1 | 10/2005 | Anders et al. | |
| 2007/0179030 | A1 | 8/2007 | Slawinski | |
| 2010/0216600 | A1 | 8/2010 | Noffsinger | |

OTHER PUBLICATIONS

ISR from PCT/US2014/029178 dated Sep. 28, 2014.

* cited by examiner

FRONT VIEW

TOP VIEW

SIDE VIEW

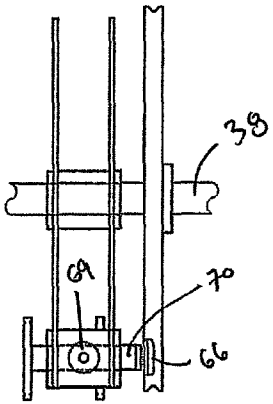
FIG. 17
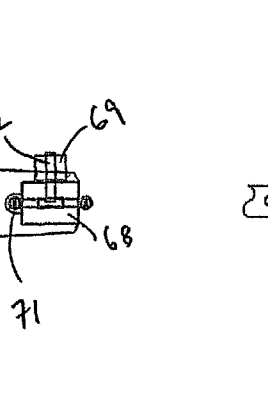
FIG. 18
FIG. 19
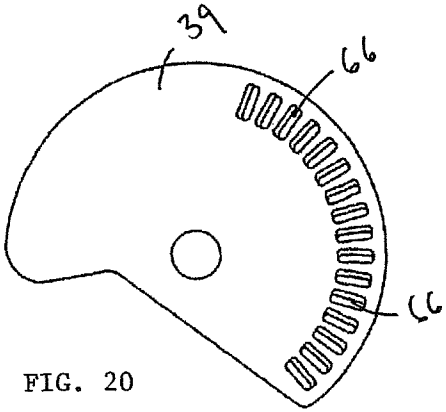
FIG. 20
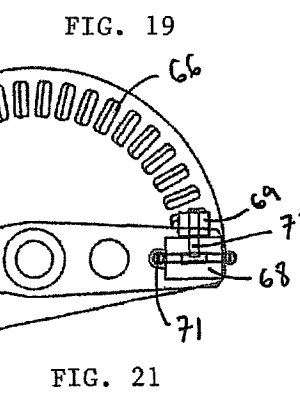
FIG. 21

TENSION SYSTEMS AND METHODS OF USE

BACKGROUND OF THE INVENTION

1. Field of the Invention

The present invention relates to cable tensioning systems, and more particularly to unique and compact adjustable cable tensioning systems, apparatus, machines and related methods for use in such applications as weight training, exercising, muscle toning, muscle development, and the like.

2. Description of Related Art

Weight training is a common form of exercise to increase strength and build muscle. A typical weight lifting apparatus includes a bar that is capable of receiving weights on both ends. The user places the desired weights on the bar, and then lifts the bar so that the weights act as resistance to the muscles of the user. A certain number of repetitions of the lift are performed in order to complete a particular exercise. Typically, the most beneficial parts of the exercise are the last few repetitions where the user may become fatigued, but where maximum muscle strength is developed. Because of the fatigue factor, the user may become exhausted and unable to complete the exercise with the selected weights. This results in at least two problems. First, in order to complete the set of repetitions, if fatigue sets in, the user may be required to stop the exercise, change the weight resistance (which may include both removing and replacing weights), and then resume. This may interrupt critical timing in the exercise. Second, the fatigue experienced by the user is dangerous in that the weights may be dropped or mishandled, resulting in injury to the user. A second person or spotter is typically used to assist the weight lifter to catch the weight in case fatigue causes a problem. However, a second person is not always available which may expose the weight lifter to unnecessary risk of injury.

In order to avoid having to add and remove physical weights to change the resistance, numerous weightlifting systems have been developed as alternatives to bar and weight systems that employ cable and pulley systems to transfer weight loads, such as those described in U.S. Pat. No. 5,407,403 and U.S. Patent Application Publication No. 2005/0233871. In order to avoid the need for a second person to act as a spotter, cable and pulley systems have also been developed for use as spotter systems, such as those described in U.S. Pat. Nos. 5,048,826, 5,310,394, 5,314,394, and 6,558,299. Unfortunately, none of these inventions provides a simple, compact weight resistance system that has the combined capabilities of (a) providing variable adjustability in the amount of tension (weight) placed on the cable, including automatic tension adjustment (reduction or release) near the end of a set of repetitions when the user is becoming fatigued; and (b) providing an automatic spotting/safety function without the need for a second person.

Electronic monitoring and feedback systems for weightlifting have also been developed, as described in U.S. Pat. Nos. 5,785,632 and 5,993,356.

It is therefore desirable to provide the combined capabilities of variable and automatic tension adjustability, including reduction and potential release (spotting) in a compact tension resistance system that may be adapted for use in numerous different weight lifting methods and apparatus. It is further desirable that such systems provide real time feedback to the user during exercise, and record the results of the user's exercise for future use.

SUMMARY OF THE INVENTION

Embodiments of the present invention provide apparatuses, machines, systems and methods for providing adjustable tension to cable, rope, wire, cord, chain, belt, strap or other similar devices (sometimes referred to herein for convenience using the general term "cable") using a pivotally mounted leverage mechanism that is associated with one or more adjustably positionable weights. In embodiments of the invention, one or more cables are attached to the leverage mechanism which provides tension to the cable(s). Tension to the cable(s) may be increased or decreased by changing the position of the weight(s) associated with the leverage mechanism. Embodiments of the invention may be used in exercise and other muscle strengthening devices, and may include an electronic control system for monitoring and recording a user's progress, and altering or releasing tension to the cable system based on feedback from the user. Embodiments of the invention may also include a user interface for inputting information for particular exercises or workouts, as well as outputting/downloading information following exercises or workouts.

In some embodiments, the leverage mechanism includes an elongated threaded screw member that is rotated using a drive motor attached at one end of the screw member. A carriage may be provided in these embodiments that is movably engaged with the screw member so that rotation of the screw member by the drive motor causes the carriage to move along the length of the screw member. In these embodiments, rotation of the screw member in one direction will cause the carriage to move in one direction along the lever member, and rotation in the opposite direction will cause the carriage to move in the opposite direction along the lever member. In some embodiments, the screw member itself may be pivotally (and rotatably) mounted in order to act as a lever.

A cable is attached directly or indirectly at or near one end of the lever mechanism or screw member. Tension on the cable is increased or decreased depending on the position of the weight (which may be on a carriage) on the lever member.

In alternative embodiments, the carriage may be movably provided on one or more elongated rails, tracks or other supports. In these embodiments, the rail, track or support is pivotally mounted in order to act as a lever, and a cable is attached directly or indirectly near one end of the rail, track or support. It is to be appreciated that the movable weight or the carriage supporting the weight may be directly or indirectly attached to any suitable motion imparting device, such as a pneumatic or hydraulic piston assembly, a rod and motor assembly, a threaded screw member as described above, a chain and sprocket system, a motor and belt system, or the like. Movement of the piston, motor, chain, belt etc. causes the weight or carriage to move along the rail, track or other support lever. Tension on the cable is increased or decreased depending on the position of the weight or the carriage on the lever.

It is to be appreciated that the carriage may be provided in any suitable form so long as it is movable along the lever mechanism according to the movement of the motion imparting device. In some of these embodiments, additional weight is provided on or attached to the carriage.

In the preferred embodiments, one end of a cable is attached directly or indirectly near an end of the leverage mechanism, and the other end of the cable is attached to and threaded around a rotatably mounted disc, pulley or sprocket for communication of tension to such disc, pulley or sprocket. In these embodiments, the central axis of such disc, pulley or sprocket is attached to a rod. A separate cam is also attached to this rod such that the disc and cam share a common axis in the rod. One end of a second cable is attached to and wrapped around the outside edge of the cam, and the opposite end of the second cable is attached directly or indirectly to a weight lifting bar or the like for communication of tension to such bar. It is to be appreciated that the outside edges of the disc and cam may have a U-shaped cross section in embodiments using a cord-like structure for the two cables in order to receive and guide the cables. Other embodiments may use sprockets and chains or belts, which may be connected, on one end to cables leading to the lever mechanism and on the other end to the lifting bar.

In some embodiments, tension is imparted to the disc by the first cable, then transmitted to the cam through the rod, and then transmitted directly or indirectly to the lifting bar through the second cable. The amount of tension may be varied depending on the position of the carriage, and/or the associated weight thereon, relative to the point at which the first cable is attached to the leverage mechanism. The tension may also affected by the location of the pivot. As the lifting bar is moved, it pulls on the second cable thereby causing the cam to rotate. This rotation is resisted by the tension imparted to the cam from the leverage mechanism through the first cable, and rod and/or disc. When the tension provided by the second cable is greater than the tension provided by the first cable, both the cam and disc rotate, causing the leverage mechanism to move through an arc about its pivotal mount. The outside edge of the cam is preferably shaped so as to provide even tension to the second cable to compensate for variations as the leverage mechanism moves through this arc. This shape of the cam helps maintain consistent cable tension throughout the upward and downward strokes of the lifting bar.

It is to be appreciated that the amount of tension imparted increases as the carriage and/or weight are moved closer to the end of the leverage mechanism where the first cable is attached (for example, at a point that is away from the pivot); similarly, the amount of tension is decreased as the carriage and/or weight are moved away from the end of the leverage mechanism where the first cable is attached (for example, at a point that is toward the pivot). It is to be appreciated that the leverage mechanisms of the present invention may be provided in different lengths, and that the weight(s) associated with the carriage may be provided in different amounts depending on the space availability and the tension requirements of the user. For example, and without limitation, a relatively short leverage mechanism may be provided with a heavy weight such that slight movement of the weight and/or carriage results in a significant change in tension; but, if a longer leverage mechanism is provided with the same weight the same amount of movement by the weight and/or carriage would provide a lesser change in tension. In some examples, a longer leverage mechanism could allow for a greater maximum tension than a shorter one.

In the preferred embodiments, the position of the weight and/or carriage is calibrated in order to allow calculation of the amount of tension provided by the leverage mechanism. An electronic interface and processing system may be provided in these embodiments so that a user may electronically select and/or adjust the tension ("weight") placed on the cables by changing the position of the weight on the lever mechanism. This replaces the need to add or remove actual physical weights as in a traditional weight-lifting setup. The electronic system may monitor the user's resistance to tension on the cable during use in order to detect potential fatigue in the user. In these embodiments, if the user's resistance drops, the electronic system may automatically adjust (lessen) the tension on the cable by causing the weight and/or carriage to move, in order to reduce the tension on the cable and allow the user to stop, alter or continue exercise at a different level. The electronic interface may also provide signals to the user during use, such as digital readouts, alarms, audible commands or the like. In some embodiments, the electronic system may also record data from a user's exercise workouts for compilation and later review by the user to measure muscle strength gain, for evaluation, for comparison to previous workouts, for developing future workouts, etc. In some embodiments, data recorded through the electronic system may be transmitted or downloaded to another computerized device, including portable and/or hand-held computing devices, either simultaneously with the performance of a workout, or afterwards.

In embodiments of the invention, the electronic system detects when the lifting speed of the cables decreases or stalls, and automatically/incrementally reduces the tension on the cables so that the speed stays the same. This has the effect of being an "automatic spotter" allowing the lifter to complete a lift with lesser weight. In emergency situations (e.g., a prolonged stall, or a sudden loss in resistance by the user—which may be measured in fractions of a second) the tension on the cables may be completely released or interrupted in order to avoid injury to the user. In some embodiments, a separate spotter cable may be provided with a latch or other movement arresting mechanism that may be engaged to prevent the lifting bar from falling on the user.

Several embodiments of the present invention may be implemented in various exercise machines. For example, and without limitation, embodiments of the invention may be implemented in weight lifting systems, bench press systems, squat systems, knee lift systems, hand or arm pull systems, leg presses, calf raisers, and others. Embodiments of the present invention may be used at gymnasiums, in the medical field for strengthening, development and/or rehabilitation of infirm or injured persons, and in weight or strength training camps.

It is therefore an object of the present invention to provide variable and automatic cable tension adjustability, including tension reduction and potential tension release, in a compact tension resistance system that may be adapted for use in numerous different exercise or strengthening methods and apparatus.

It is also an object of the present invention to provide cable-based systems, apparatus, machines and methods for exercise and improving muscle strength in which the tension (weight) on the cable(s) may be adjusted by a user without manually attaching or removing physical weights.

It is also an object of the present invention to provide cable-based systems, apparatus, machines and methods for exercise and improving muscle strength in which the user's activity is monitored, and the tension (weight) on the cable(s) is automatically adjusted according to the monitored activity.

It is also an object of the present invention to provide cable-based exercise or strength improvement systems and methods for providing real time feedback to a user during exercise, and real time cable tension adjustment during exercise.

It is also an object of the present invention to provide cable-based exercise or strength improvement systems and methods capable of acting as an automatic spotter to monitor and automatically reduce or eliminate tension (weight) on the cable system if user fatigue is detected.

It is also an object of the present invention to provide cable-based exercise or strength improvement systems and methods capable of recording and storing the results of a user's exercise, and making those results available for download onto a hand held or other electronic device.

Additional objects of the invention will be apparent from the detailed description and the claims herein.

BRIEF DESCRIPTION OF THE DRAWINGS

FIG. 17 is a side view of a part of the emergency tension interruption apparatus of FIG. 16.

FIG. 18 is an end view of a part of the emergency tension interruption apparatus of FIG. 16.

FIG. 19 is a top view of a part of the emergency tension interruption apparatus of FIG. 16.

FIG. 20 is a side view of a part of the emergency tension interruption apparatus of FIG. 16.

FIG. 21 is a side view of a part of the emergency tension interruption apparatus of FIG. 16.

DETAILED DESCRIPTION

Figure 1:
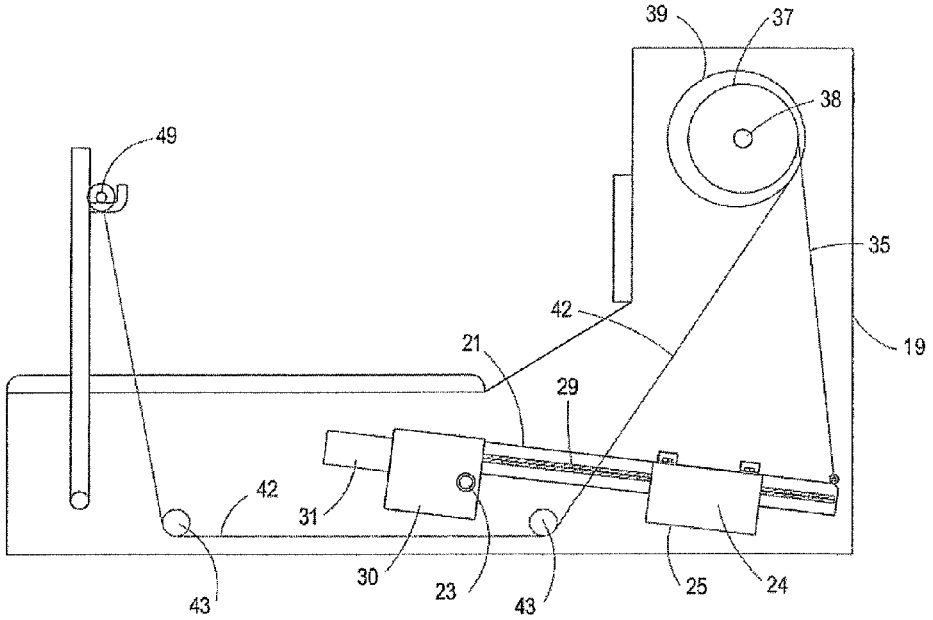
FIG. 1 is a sectional side view of an embodiment of the invention showing a lifting bar near the middle of a stroke, resting on supports.
Figure 2:
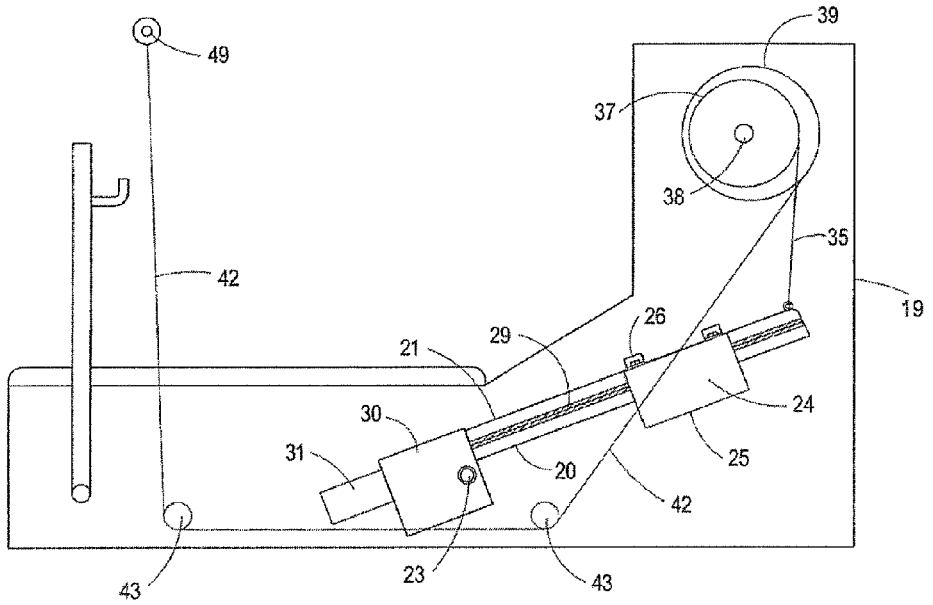
FIG. 2 is a sectional side sectional view of an embodiment of the invention showing a lifting bar near the top of a stroke.

Referring to the drawings wherein like reference characters designate like or corresponding parts throughout the several views, and referring particularly to the exemplary embodiments of FIGS. 3-9, it is seen that these embodiments include a leverage system for installation inside a cabinet or frame 19 comprising an elongated member 20 having a track 21 (see FIG. 9) for supporting a movable carriage 25 using wheels, guides or other supports 26. At least one weight 24 is provided with, on or made a part of carriage 25. Member 20 is pivotally mounted at 23 so that it may operate as a lever. It is to be appreciated that in other embodiments (such as the embodiment illustrated in FIG. 15), that weight 24 may be movably provided directly on lever member 20.

Figure 1A:
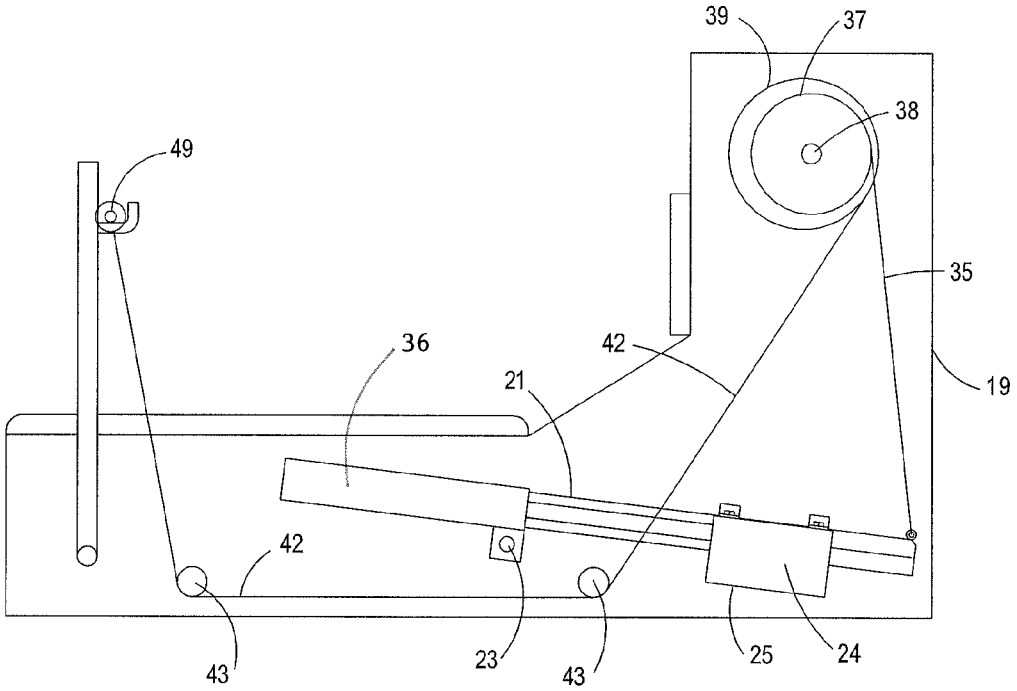
FIG. 1A is a sectional side view of an alternative embodiment of the invention showing a piston assembly.

In the embodiments illustrated in FIGS. 3-9, a threaded screw 29 is provided in parallel with lever member 20. A drive motor 30 is provided, preferably at one end of screw 29, to impart rotation to it. A threaded bore (see FIG. 9) is provided in carriage 25 for receiving screw 29, so that as screw 29 is turned by motor 30, carriage 25 moves along the length of screw 29. It is to be appreciated that turning screw 29 in one direction will cause carriage 25 to move towards, motor 30, and turning screw 29 in the opposite direction will cause carriage 25 to move away from motor 30. It is to be appreciated that in other embodiments, weight 24 may be movably provided directly on lever member 20 and that screw 29 may be threaded through a bore in weight 24 itself. However, it is to be appreciated that other means of moving weight 24 on lever member 20 are contemplated in accordance with some embodiments of the present invention. For example, and without limitation, motor 30 and screw 29 can be replaced with a piston 36 engaged with the carriage 25 as shown in FIG. 1A.

One end of a first cable 35 is attached near one end of lever member 20, at a distance from pivot 23. The opposite end of cable 35 is wrapped around an outside edge of a rotatable circular disc 37 and may be anchored thereto. Disc 37 is attached to a rod 38 that is rotatably mounted a distance from the end of lever member 20. A cam 39 is also attached to rod 38 and/or disc 37. It is to be appreciated that disc 37 may have a round circumference, but that cam 39 may not. Rotation of disc 37 causes cable 35 to impart a pulling force at the end of lever member 20 where cable 35 is attached, which causes this proximal end of lever member 20 to move in an arcuate direction about pivot 23. The closer that weight 24 (with or without carriage 25) is to this proximal end of lever member 20 and/or the point of attachment of first cable 35, the more pulling force is required through cable 35 to move lever member 20 in the arcuate direction 52.

Figure 3:
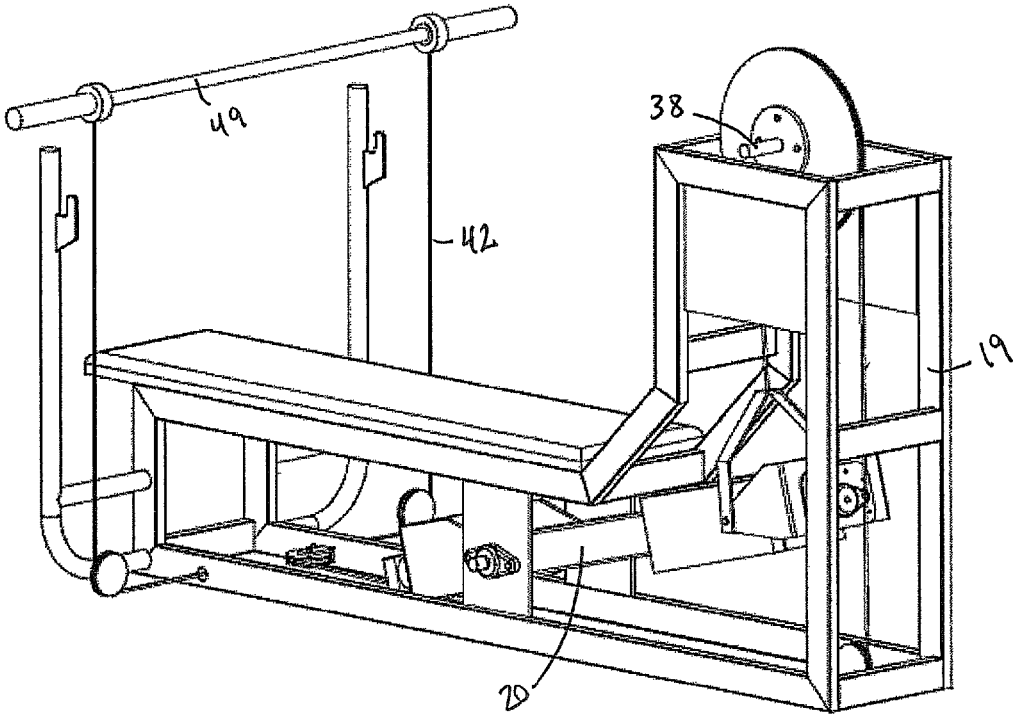
FIG. 3 is a perspective view of an embodiment of the invention showing a lifting bar near the top of a stroke.
Figure 4:
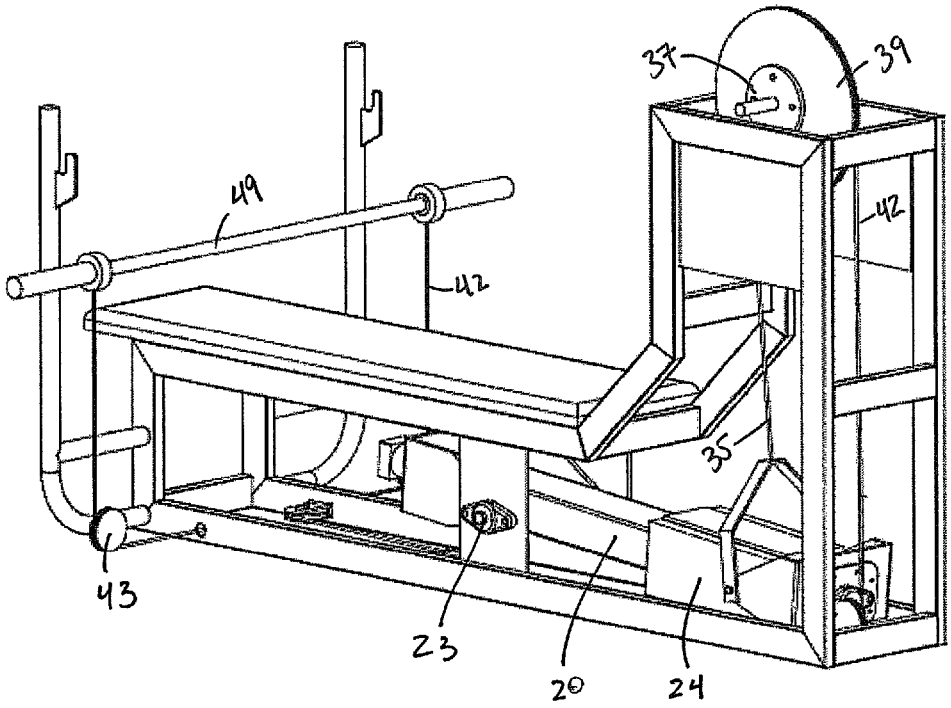
FIG. 4 is a perspective view of an embodiment of the invention showing a lifting bar near the bottom of a stroke.

One end of a second cable 42 is wrapped around an outside edge of cam 39 and may be anchored thereto. The opposite end of this cable is attached directly or indirectly to a lifting bar 49. Cable 42 is preferably split, or otherwise functionally divided, and threaded through one or more pulleys 43, terminating at opposite ends of lifting bar 49. In some embodiments, cable 42 may be attached to a separate pulley 45 that is engaged with a third cable 51, the ends of which are attached near the ends of bar 49 (See, e.g., FIG. 14). It is to be appreciated that as bar 49 is lifted as shown in FIGS. 3-4, a pulling force is transmitted through cable 42 to cam 39. This force is transmitted directly, or through rod 38, to disc 37, and then through cable 35 to the proximal end of lever member 20. Resistance to this force is provided by the weight 24, which may be provided on carriage 25. The amount of resistance may be changed by changing the position of weight 24 and/or carriage 25 on lever member 20. The movement of weight 24 on carriage 25 in the embodiments of FIGS. 2-9 is accomplished by the operation of motor 30, encoder 31 and screw 29. The outside edge of cam 39 may be shaped so as to keep the tension on cable 42 and lifting bar 49 consistent, in order to compensate for the upward/downward stroke of the bar 49 and the corresponding arcuate movement 52 of lever 20. It is to be appreciated that the shape of such a cam is related, among other things, to the length of the distance between pivot 23 and the proximal end of lever 20.

Detail of an exemplary cam and disc assembly are shown in FIGS. 10-13. In this embodiment, one end of cable 35 is attached to the proximal end of lever 20, and the opposite end is wrapped over an outside edge of disc 37, and attached thereto. The position of weight 24 on lever 20 determines the amount of tension provided through cable 35 to disc 37. Disc 37 is attached to central rod 38. Cam 39 is also attached to central rod 38. However, in some embodiments, disc 37 and cam 39 may be engaged together, for example, and without limitation, by rivets, screws, and/or bolts. In other embodiments, disc 37 and cam 39 can both be integrated on a unitary material, for example, and without limitation, by injection molding or casting. These alternative embodiments eliminate the need for rod 38. Referring back to the exemplary embodiments of FIGS. 10-21, it is seen that one end of another cable 42 is engaged over the outside edge of cam 39 and attached thereto, leading directly or indirectly to lifting rod 49. It is to be appreciated in order to rotate disc 37 rod 38 and/or cam 39, an opposing force equal to or greater than that from cable 35 is necessary. This opposing force is transmitted from lifting rod 49 through cable 42 to cam 39, and in the illustrated embodiment, through rod 38 to disc 35.

Figure 5:
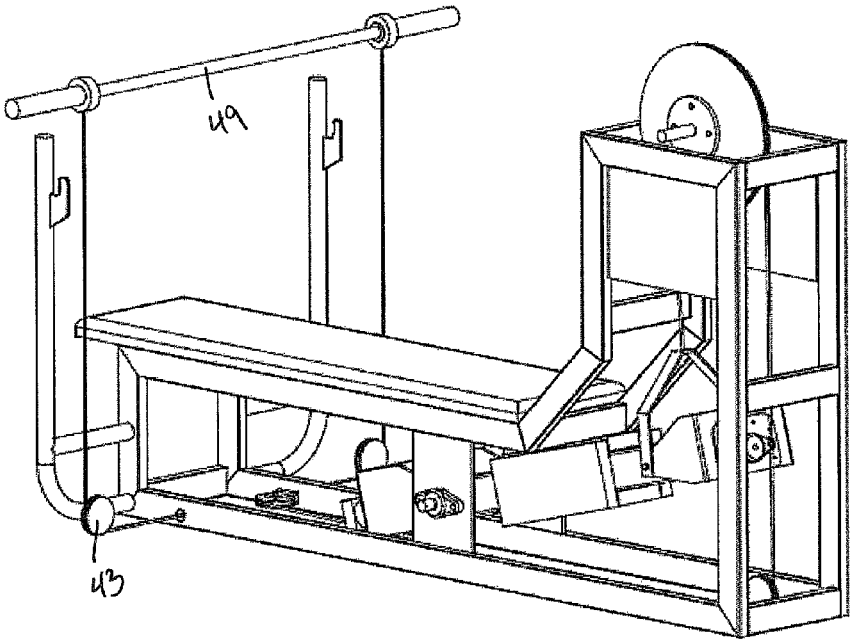
FIG. 5 is a perspective view of an embodiment of the invention showing a lifting bar near the top of a stroke.
Figure 6:
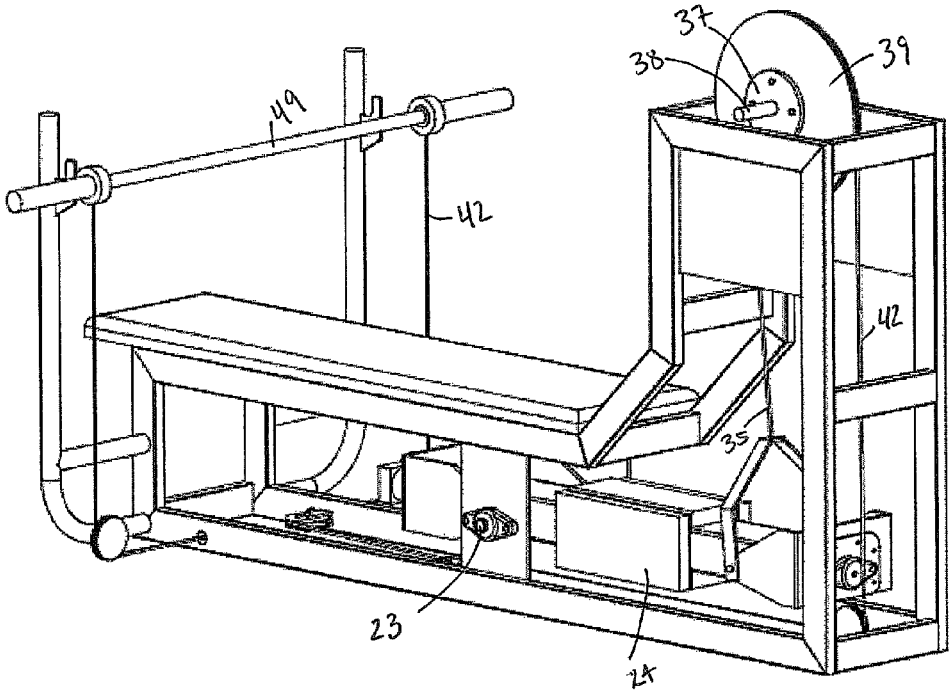
FIG. 6 is a perspective view of an embodiment of the invention showing a lifting bar near the middle of a stroke.
Figure 7:
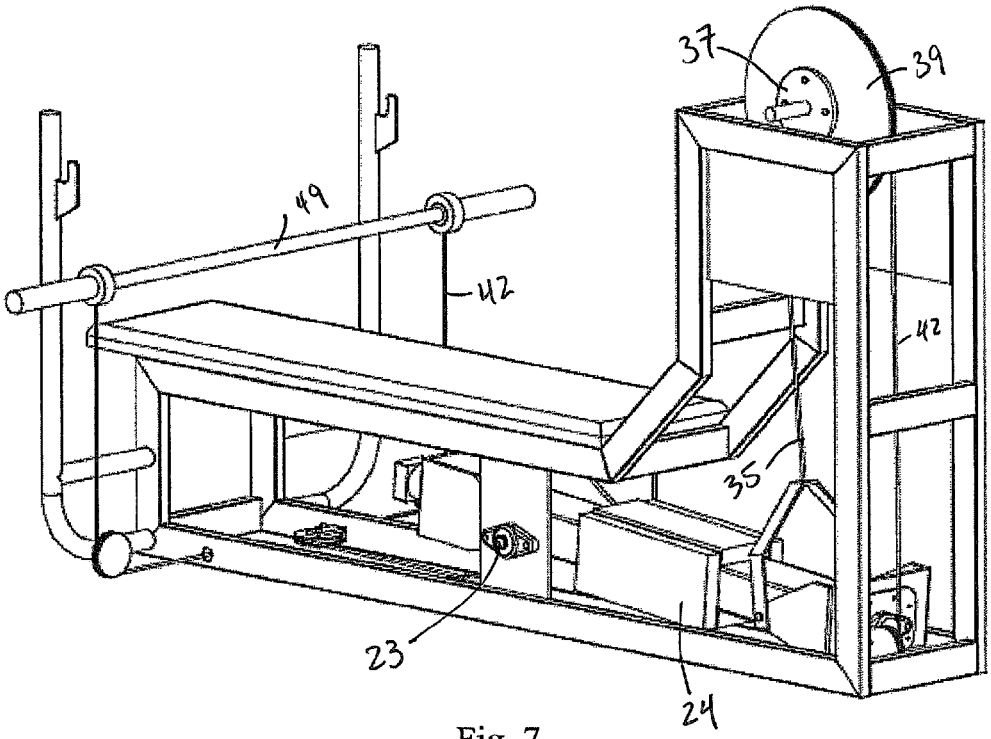
FIG. 7 is a perspective view of an embodiment of the invention showing a lifting bar near the bottom of a stroke.
Figure 8:
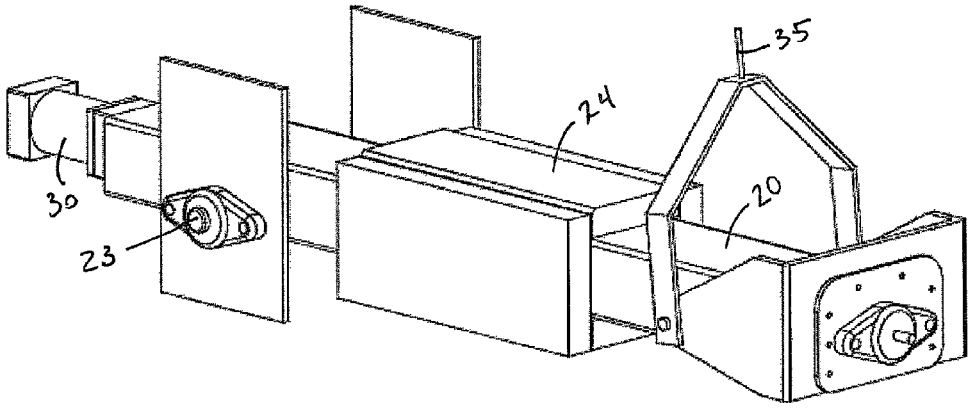
FIG. 8 is a perspective view of an embodiment of a leverage mechanism of the present invention.
Figure 9:
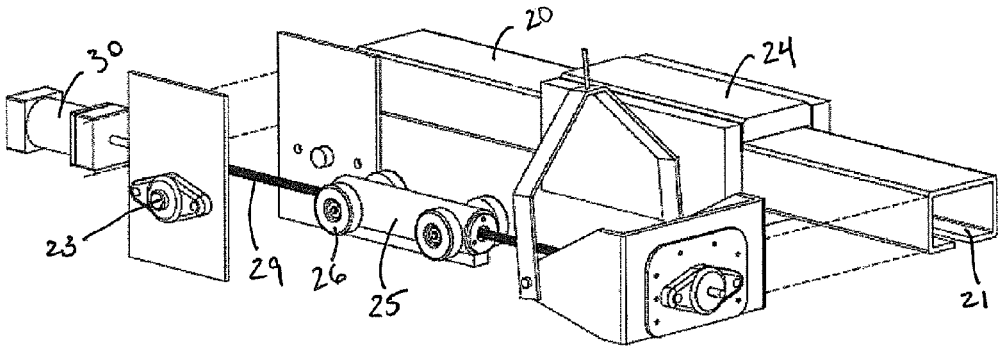
FIG. 9 is a partially exploded view of the leverage mechanism of FIG. 8.
Figure 10:
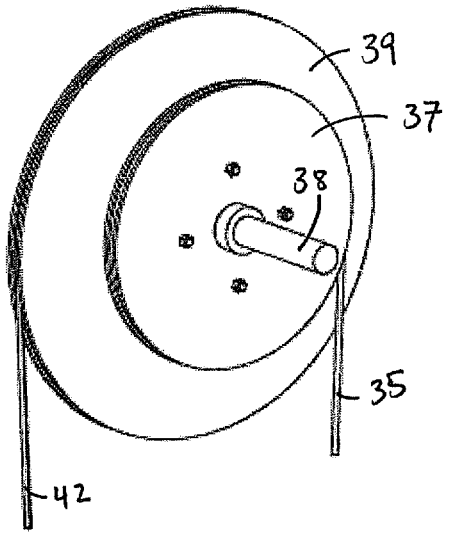
FIG. 10 is a perspective view of an embodiment of a cam and disc assembly of the present invention.
Figure 11:
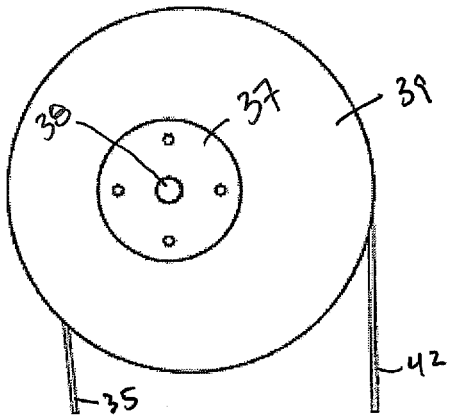
FIG. 11 is a front view of the assembly of FIG. 10.
Figure 12:
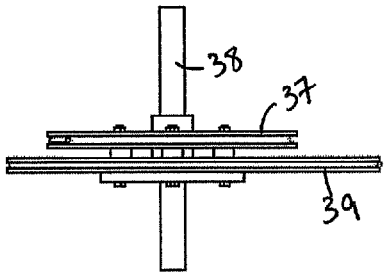
FIG. 12 is a top view of the assembly of FIG. 10.
Figure 13:
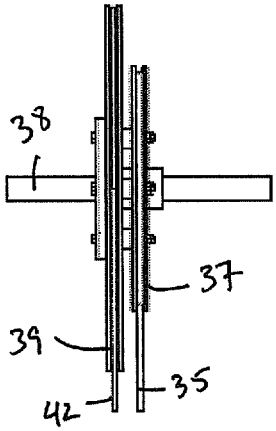
FIG. 13 is a side view of the assembly of FIG. 10.

In the exemplary embodiment shown in FIGS. 3 and 4, the position of carriage 25 and weight 24 has been moved toward the end of lever 20 for a maximum load (for example, and without limitation, 190 lbs.). FIG. 3 shows the position of an exemplary leverage system of the present invention near the top of a lifting stroke, and FIG. 4 shows the change in position near the bottom of a lifting stroke. In the exemplary embodiment shown in FIGS. 5-7, the position of carriage 25 and weight 24 has been moved toward the middle of lever 20 for a normal load (for example, and without limitation, 140 lbs.). FIG. 5 shows the position of an exemplary leverage system of the present invention near the top of a lifting stroke, FIG. 6 shows the change in position near the middle of a lifting stroke, and FIG. 7 shows the change in position near the bottom of a lifting stroke.

Figure 15:
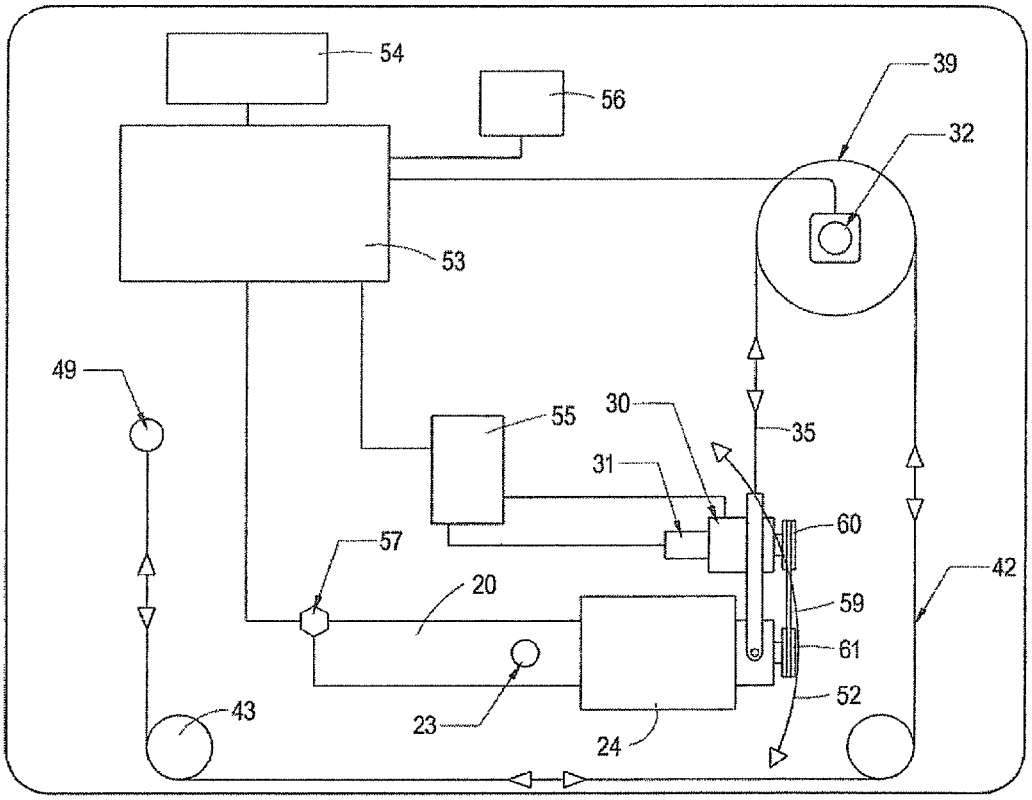
FIG. 15 is a schematic view of an alternative embodiment of the invention.

Referring to the illustrated exemplary embodiment of FIG. 15, it is seen that some embodiments of the invention may include an electronic system 53 having either manual inputs such as buttons, dials, switches, or the like (including without limitation one or more keypads), and/or electronic inputs and outputs such as a magnetic or optical reader, USB or other port, etc. provided on or with a user interface 54. A display is also provided in preferred embodiments of the user interface 54. The user may input his/her identity and other information regarding the desired workout using any of these inputs (keypad, manual ID number input, magnetic ID card, upload from a portable electronic device, etc.). Embodiments of the system 53 maintain information about each user and workouts performed by that user, from inputs on interface 53 or other data sources, discussed more fully below, for later review and/or download. A user's workout parameters may include such things as, without limitation, the weight(s) (tension) to be applied during a particular workout; number of repetitions for the workout; desired time interval(s) between repetitions and/or a time to complete the entire workout; any scheduled changes to be made to the tension during the workout (e.g. increasing, decreasing and/or alternating tension for different repetitions in the workout); ranges of acceptable deviations from any of tension, repetitions, time interval(s), etc.; and/or whether or not to record feedback from the workout. It is to be appreciated that different combinations of these selections may be made by the user to more particularly tailor a given workout or exercise regimen.

Some embodiments of the invention include a port or networking link 56 that allows data stored in the electronic system of the present invention to be accessed and/or downloaded, directly or indirectly, from or onto another device, such as a PDA, iPod, local storage, removable storage, network storage, network computer, or the like. This makes the data available for the user to incorporate into other databases, programs or devices for archival, study, entertainment, competition or other purposes. For example, and without limitation, a person going through rehabilitation following an accident or injury is able to keep track of exercises performed on machines of the present invention, and make comparisons to determine whether improvements are taking place over a period of time.

The programmable electronic system 53 is provided to control, among other things, motor 30 and the position of carriage 25 and/or weight 24 on lever mechanism 20 via screw 29. An encoder 31 is provided with motor 30, which is preferably a servo motor. Encoder 31 is calibrated in conjunction with motor 30, shaft 29, and weight 24 so that system 53 knows the precise position of weight 24 on lever 20 which can be used to determine the amount of weight (tension) provided on cable 35. The precision of the amount of weight provided depends on the type of encoder used, but in an exemplary embodiment, encoder 31 may count as many as 10,000 pulses for each rotation of shaft 29, although other less-precise encoders may be used and still provide satisfactory precision.

Referring to the exemplary alternative embodiment of FIG. 15, it is seen that a servo motor 30 and associated encoder 31 are provided in a roughly parallel orientation with lever 20. One end of motor 30 and a corresponding end of lever 20 are each provided with a rotatable wheel or sprocket around which a belt, chain, cable or other motion transmitter is provided to transfer rotational movement from the wheel or sprocket 60 on motor 30 to the wheel or sprocket 61 on lever 20. Wheel 61 is, in turn, associated with movable weight 24 such that rotation in one direction causes weight 24 to move in one direction along lever 20, and rotation in the opposite direction causes weight 24 to move in the opposite direction along lever 20.

Using the interface 54 and/or link 56, a user may select a desired amount of tension (for example, and without limitation, 140 lbs.), and in response, the system 53 operates motor 30 to move weight/carriage 24/25 to an appropriate location on lever 20 to provide the requested resistance to the cables leading to lifting bar 49. System 53 may or may not use an additional controller or other driver 55 to operate motor 30. The user interface 54 preferably includes controls that are easy to read and use, that are positioned close to the user, so that, if desired, adjustments in tension may be easily and quickly accomplished before, after or even during a set of repetitions.

Figure 14:
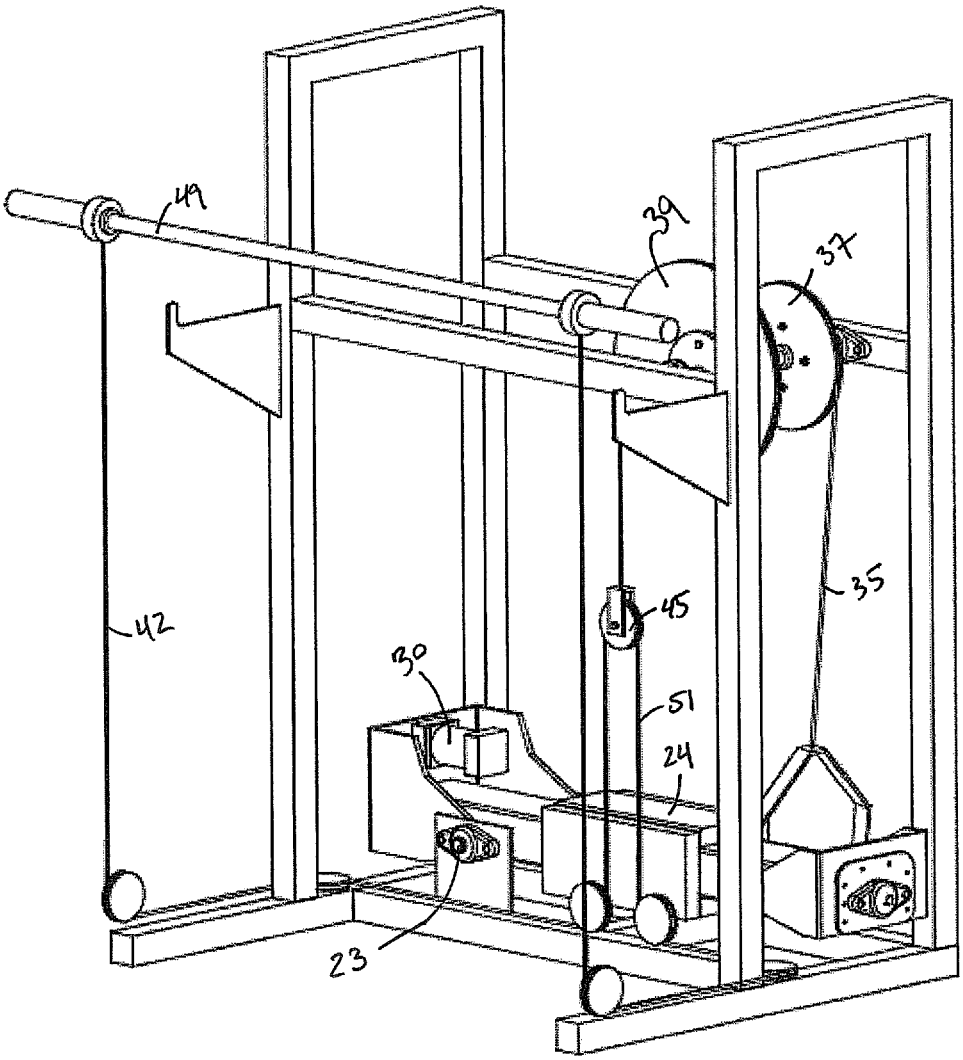
FIG. 14 is a perspective view of an alternative embodiment of the present invention.

Another encoder 32 is provided with rod 38, as shown in FIG. 14. During use, the programmable electronic system 53 monitors information received from encoder 32 which indicates the time and distance expended by the user during lifting repetitions. When this information is combined with the weight position information from encoder 31, system 53 can indicate the amount of force, energy, or other exercise parameters expended by the user. The system is preferably programmed to move the weight/carriage 24/25 in order to reduce the tension on the cables, if a decrease in the force provided by the user is detected through encoder 32. This reduction in tension is accomplished in real time, and may help the user to maintain consistency in the amount of time the user takes to complete a repetition by, for example, lowering tension level. For safety purposes, if a drastic reduction, loss, or unexpected reversal in force from the user is detected through encoder 32—indicating significant user fatigue—the programming in system 53 may cause motor 30 to rapidly move weight 24 away from the proximal end of lever 20, so as to release or reduce tension to the cables leading to the lifting rod 49, thereby acting as a spotter, to avoid injury to the user.

In some embodiments, a ratchet system such as that shown in FIGS. 16-21 may be provided with disc 37, rod 38 and/or cam 39. In these embodiments, if an emergency situation is detected, the ratchet system may be engaged to prevent disc 37, rod 38 and/or cam 39 from rotating backwards, thereby acting as a spotter and preventing any tension from being imparted to bar 49. Referring to the exemplary spotter system embodiment of FIGS. 16-21, it is seen that cam 39 is provided with a plurality of slotted openings 66. A safety latch housing 68 is provided supporting a spring-loaded latch 70. Latch 70 is designed to fit into one of the openings 66 of cam 39. A pin 72 attached to an electronically activatable coil 69 that is engaged with latch 70 to hold it off from insertion into one of openings 66 during normal use. However, should an emergency situation be detected, coil 69 may be activated in order to pull pin 72 from latch 70, causing springs 71 to urge latch 70 forward for engagement into the nearest opening 66, thereby preventing rotation of cam 39, and preventing tension from being transmitted to bar 49 through cable 42. It is to be appreciated other embodiments of spotter devices may be used including without limitation, devices to arrest movement of the cables, devices to disconnect or detach (release) one or more cables, etc. For example, and without limitation, instead of being provided in conjunction with the cam 39, the ratchet system (including the latch and openings described above) can be used in conjunction with the disc 37, rod 38, or some other device rotatable around rod 38. In other examples, the safety system can include a separate device engaged with the rod 38, such as a mechanical or electromechanical brake.

Figure 16:
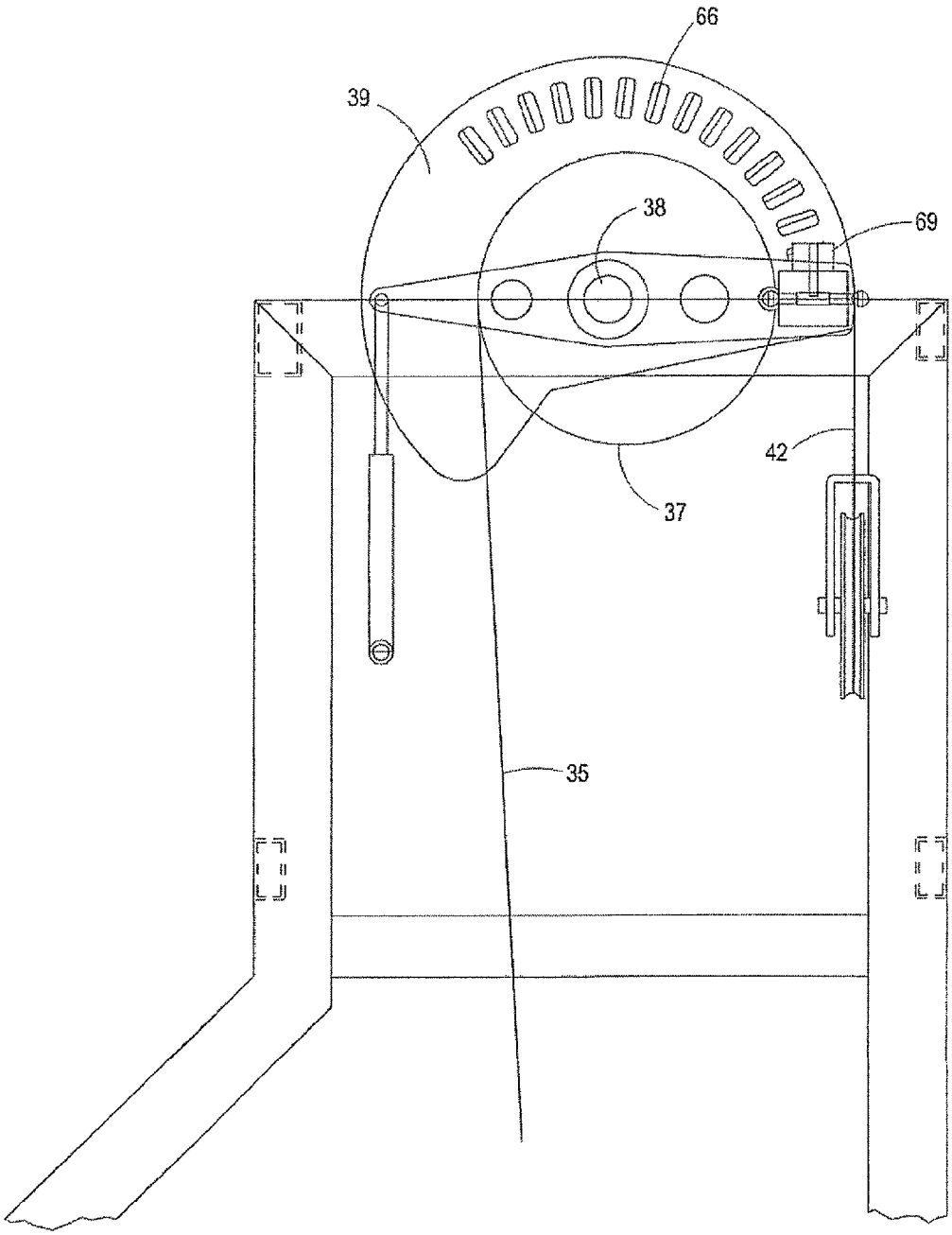
FIG. 16 is a partially cut-away sectional side view of an embodiment of the invention incorporating an emergency tension interruption apparatus.

In some embodiments, one or more additional hold-off or safety cables (not shown) may be attached to the lifting bar 49, and to a safety mechanism similar to that shown in FIG. 16. Should the system detect fatigue in the user, this safety mechanism may be engaged so that the safety cable(s) arrest downward movement of the lifting bar to prevent it from falling or landing on the user.

In most embodiments, upon each start-up, motor 30 preferably moves the weight 24 back to a given home or start position such as 57, and may also perform diagnostics or other internal tests to ensure calibration of the system and encoders. It is expected that the system calibration may be certified by a local city or state weight and measurement department to confirm delivered tension (weight) to bar 49.

Additional programming may be provided in the electronic system to allow the user to designate different amounts of tension/resistance for different repetitions of a set. For example, and without limitation, the user may program the first five repetitions of a set to be at 140 lbs., and the next five to be at 120 lbs. Accordingly, for this example, during use, system 53 will cause weight 24 to be moved after the first five repetitions to a different position on lever 20 in order to change the tension on cables from 140 lbs. to 120 lbs. In other examples, and without limitation, a user may set a total number of repetitions at a given tension or tension reduction per repetition; or the user may establish a second set of repetitions with a lower or higher tension such as: 10 repetitions at 120 pounds tension; or 15 repetitions at 120 pounds tension, then back off or add ½ to 20 pounds per repetition; or a first set of repetitions at one tension, followed by a second set of repetitions at a lower or higher tension. It is to be appreciated that in other examples, and without limitation, the user may program alternating, increasing, decreasing or other variations in tension (weight) for different strokes or repetitions during one or more workouts. In other examples, a predefined weight lifting program can be stored in the system, provided through interface 54 or link 56.

It is to be appreciated that other variations may be employed by the system, including without limitation, weight (tension), stroke and/or time, in order to compensate for real-time variations encountered by a user during a given workout.

For example, and without limitation, a user may select a total number of repetitions and a weight (tension) start point. The system 53 may then reduce or hold a selected amount of weight for every stroke until the repetition count is completed. In this example, the user may enter 150 pounds for the start weight and 10 repetitions. The user also sets the weight to be reduced per stroke from a range of ½ pound steps to 20 pounds per stroke. During such a workout, the tension is changed, for example, by ½ pound each repetition. At the end of the 10 repetitions, the tension is removed, leaving the weight of the bar 49 only.

With respect to stroke, it is to be appreciated that encoder 32 on shaft 38 may be used to keep track of the total stroke distance. As an example, and without limitation, when a first-time or new user enters his/her identification into the system (e.g. swipes a card), the system may require the user to go through a set of repetitions (e.g. 5 of them) at a low tension to learn the users stroke distance and save it in association with the user's ID. This information is gleaned from encoder 32 as the user causes shaft 38 to rotate during each repetition. In some examples, the system may also require the user to hold bar 49 (perhaps at ¾ stroke) as the tension is increased, while at the same time monitoring any movement on shaft 38 to determine the approximate strength abilities of the user. The stroke and/or strength information may then be used later during this user's workouts; for example, during a later workout, as encoder 32 monitors the stroke distances for the user, the system may reduce tension (by moving weight 24 on lever 20) if it detects that the user is not reaching his/her predetermined stroke distance during a set of repetitions. This reduction in tension may enable the user to continue reaching the full stroke distance albeit at a lower tension (weight). The weight reduction information may also be recorded so that the user may review it after the workout to see when and by how much the weight was reduced in order for the user to complete a given workout while maintaining the same stroke distance. This feature may be enabled or disabled at the discretion of the user.

With respect to time, it is to be appreciated that encoder 32 on shaft 38 may be used to keep track of the time it takes for a user to complete each stroke. As an example, and without limitation, an initial time benchmark may be established for a user to complete one stroke and/or an average time may be calculated for a user based on strokes completed during one or more actual workouts. Then, during a later workout, as encoder 32 monitors the stroke time for the user, the system may reduce tension (by moving weight 24 on lever 20) if it detects that the user is taking more time than the benchmark/average stroke time during a set of repetitions. This reduction in tension may enable the user to continue reaching the full stroke within the average/benchmark time albeit at a lower tension (weight). The weight reduction information may also be recorded so that the user may review it after the workout to see when and by how much the weight was reduced in order for the user to complete a given workout while maintaining the same stroke time. This feature may be enabled or disabled at the discretion of the user.

It is to be appreciated that embodiments of the invention may be set to reduce or eliminate the tension to bar 49 if the user holds the bar in a fixed position for a minimal time interval (timeout) following the start of movement in a repetition—indicating fatigue (inability to move the bar further). The timeout may be any appropriate pre-set time interval, but should be short enough to avoid injury yet long enough not to interrupt an otherwise normal workout. In other variations, a total time for a series of repetitions may be established by the user and if that time is exceeded, then tension to bar 49 may be released. Recording of any or all of this information may be enabled or disabled at the discretion of the user.

It is to be understood that variations, modifications and combinations of the elements of the various embodiments of the present invention may be made without departing from the scope thereof. It is also to be understood that the present invention is not to be limited by the specific embodiments disclosed herein, but only in accordance with the appended claims when read in light of the foregoing specification.

What is claimed is:

1. A cable tension system comprising:

a) a pivotally mounted lever mechanism;

b) a weight movably engaged with said lever mechanism;

c) a motion imparting mechanism for moving said weight with respect to said lever mechanism;

d) a first cable having a first end in communication with said lever mechanism at an attachment point, and an opposite end in communication with a rotatable disc attached to a rotatable axial rod;

e) a rotatable cam fixedly engaged with said rotatable disc, said cam including a plurality of openings therein;

f) a second cable having a first end in communication with said cam, and an opposite end in communication with a lifting bar; and g) a safety latch attached to an electromechanical mechanism for automatically inserting said safety latch into one of said openings in said cam in an emergency situation;

wherein tension on said first and second cables between said lever mechanism and said lifting bar corresponds to the position of said weight with respect to said lever mechanism; wherein said cam has a shape that provides substantially even tension to said second cable as said cam rotates to compensate for movement of the lifting bar and arcuate movement of the lever mechanism; and wherein insertion of said safety latch into one of said cam openings prevents tension from being transmitted through said second cable.

2. A method of providing adjustable resistive force to a lifting bar in an exercise machine comprising the steps of:

a) coupling opposite ends of said lifting bar to an end of a pivoting lever mechanism with a cable system, wherein said cable system includes a rotatable assembly, a first cable between said lifting bar and said rotatable assembly, said rotatable assembly including a rotatable cam that has a shape that provides even tension to the first cable during lifting as the pivoting lever mechanism moves through an arc, and a second cable connecting said pivoting lever mechanism to said rotatable assembly, b) moving a weight to a position between a pivot point and said end of said lever mechanism, and c) automatically engaging a safety latch with said rotatable cam to reduce tension on said cable when a user of said exercise machine is in an emergency, wherein said rotatable cam includes a plurality of openings with which said safety latch is operable to engage when a processor directly or indirectly monitoring the movement of said pivoting lever determines that the movement of said pivoting lever stalls or reverses, indicating that the user of said exercise machine is in said emergency.

3. The method of claim 2, wherein directly or indirectly monitoring the movement of said pivoting lever comprises monitoring the rotation of at least one portion of said rotatable assembly, said rotatable assembly comprising said rotatable cam, a rotatable axial rod to which said rotatable cam is attached, and a rotatable disc attached to said rotatable axial rod and to said lifting bar by said second cable, wherein said monitoring is performed in real time during use to detect fluctuations in the rotational speed of said at least one portion of said rotatable assembly and to detect emergencies.

4. The method of claim 3, further comprising automatically adjusting the position of said weight in response to said fluctuations in the rotational speed of said rotational assembly and said emergencies.

5. The method of claim 2 wherein said step of coupling said lifting bar and said lever mechanism comprises the steps of:

a) attaching a first end of said second cable to said lever mechanism and attaching a second end of said second cable to a rotatable disc of said rotatable assembly; and b) attaching a first end of said first cable to said rotatable cam and operatively coupling a second end of said first cable to said lifting bar.

6. The method of claim 3, wherein said emergency is a stall in movement of the said one of the group consisting of said rotatable axial rod, said rotatable disc, said rotatable cam, and combinations thereof.

7. A cable tension system comprising:

a) a pivotally mounted lever mechanism;

b) a weight movably engaged with said lever mechanism;

c) a motion imparting mechanism for moving said weight with respect to said lever mechanism;

d) a first cable having a first end in communication with said lever mechanism at an attachment point, and an opposite end in communication with a rotatable disc attached to a rotatable axial rod;

e) a rotatable cam fixedly engaged with said rotatable disc;

f) an electromechanical safety latch mechanism having a latch for engaging an opening in said rotatable cam;

g) a second cable having a first end in communication with said cam, and an opposite end in communication with a lifting bar;

h) a lifting bar monitoring system including an encoder for monitoring the movement of one of the group consisting of said rotatable axial rod, said rotatable disc, said rotatable cam, and combinations thereof; and i) a processor in electronic communication with said encoder and said safety latch mechanism, wherein tension on said lifting bar is removed by the insertion of said safety latch into said opening in said cam, wherein said safety latch has a retracted position in which said safety latch is not inserted into an opening in said rotatable cam and an inserted position in which said safety latch is inserted into an opening in said rotatable cam, and said processor is operable to change the position of said safety latch between said retracted position and said inserted position.

8. The cable tension system of claim 7 wherein said cam includes a plurality of openings into which said latch is operable to be inserted when said processor determines that the rotation of said one of the group consisting of said rotatable axial rod, said rotatable disc, said rotatable cam, and combinations thereof stalls or rapidly reverses, indicating that a user of said cable tension system is in an emergency.

9. The cable tension system of claim 7 further comprising computer executable instructions adapted to cause said processor to activate said safety latching mechanism to move said latch into said inserted position when said processor determines that the rotation of said one of the group consisting of said rotatable axial rod, said rotatable disc, said rotatable cam, and combinations thereof stalls or rapidly reverses, indicating that a user of said cable tension system is in an emergency.

10. The cable tension system of claim 7 further comprising a release mechanism for disconnecting said second cable from said cam in an emergency.

11. An apparatus for providing tension to a lifting bar comprising:

a) a lever having a weight movably provided therewith, said lever having a pivoting end and an attachment end;
b) a motion imparting mechanism for moving said weight along said lever between said pivoting end and said attachment end;
c) a first cable for transmitting tension from said attachment end of said lever to a rotating axial member;
d) a rotatable cam attached to said rotating axial member;
e) a second cable for transmitting tension from said rotatable cam to a lifting bar; and
f) a safety latch mechanism automatically controlled by a processor in electronic communication with said latch mechanism for relieving tension on said first and second cables by moving said weight toward said pivoting end of said lever in an emergency.

12. The apparatus of claim 11 further comprising an encoder in electronic communication with said processor, wherein said processor automatically monitors the amount of tension imparted to said lifting bar and said processor is operable to adjust a position of said weight along said lever to automatically adjust the amount of tension imparted to said lifting bar during use of said apparatus.

13. The apparatus of claim 12 wherein said processor is in electronic communication with said motion imparting mechanism and disengages said motion imparting mechanism from said weight when a user of said apparatus is in an emergency to rapidly move said weight toward said pivoting end to eliminate the transmission of tension to said lifting bar.

14. The apparatus of claim 11 further comprising a rotatable disc connected to said rotating axial member, and an encoder in electronic communication with said processor, wherein said encoder determines over time the angular position of one of the group consisting of said rotating axial member, said rotatable disc, said rotatable cam, and combinations thereof and communicates the angular position to said processor, thereby allowing said processor to monitor the rotational speed of said one of the group consisting of said rotating axial member, said rotatable disc, said rotatable cam, and combinations thereof as an indicator of the movement of the lifting bar, wherein said processor automatically adjusts the amount of tension imparted to said lifting bar in an emergency.

15. The system of claim 14, wherein said emergency is a stall in movement of the said one of the group consisting of said rotating axial member, said rotatable disc, said rotatable cam, and combinations thereof.

16. A cable tension system comprising:
a) a pivotally mounted lever mechanism;
b) a weight movably engaged with said lever mechanism;
c) a first cable having a first end in communication with said lever mechanism at an attachment point, and an opposite end in communication with a rotatable disc attached to a rotatable axial rod;
d) a rotatable cam fixedly engaged with either said rotatable disc or said axial rod, said cam including a plurality of openings therein;
e) a second cable having a first end in communication with said cam, and an opposite end in communication with a lifting bar; and
f) a safety latch for insertion into one of said plurality of openings in said cam;

wherein insertion of said safety latch into one of said plurality of openings in said cam prevents tension from being transmitted through said second cable, insertion of said safety latch being controlled by an electronically activatable mechanism in electronic communication with a processor operable to activate said electronically activatable mechanism to insert said safety latch into one of said plurality of openings in said cam when said processor detects that a user of said cable tension system is in an emergency.

17. The system of claim 16 further comprising a motion imparting mechanism for moving said weight with respect to said lever mechanism.

18. The tension system of claim 17, wherein said processor is in electronic communication with said motion imparting mechanism.

19. The tension system of claim 18 further comprising
a first encoder in electronic communication with said processor for determining the position of said weight relative to said lever mechanism,
a second encoder in electronic communication with said processor for determining the angular position of one of the group consisting of said rotatable axial rod, said rotatable disc, said rotatable cam, and combinations thereof, and
a user interface in communication with said processor.

20. The tension system of claim 19 further comprising computer executable instructions adapted to cause said processor to detect and measure movement of said cables and to change the tension on said cables in response thereto.

21. The tension system of claim 20 wherein said safety latch is biased toward extending toward said rotatable cam to engage with one of said plurality of openings and is prevented from extending by said electronically activatable mechanism in an open condition, and said electronically activatable mechanism is in electronic communication with said processor and said processor is operable to activate said electronically activatable mechanism to change to a closed condition in which said electronically activatable mechanism releases said safety latch to engage one of said plurality of openings to thereby arrest the movement of said rotatable cam and interrupt the tension on said cables when said processor detects that said user of said tension system is in said emergency.

22. The tension system of claim 21 wherein said emergency is a stall in movement of the said one of the group consisting of said rotatable axial rod, said rotatable disc, said rotatable cam, and combinations thereof.

23. The tension system of claim 19 further comprising a data port in communication with said processor for receiving or transmitting user data, wherein said user data comprises one of the group consisting of a user identifier, workout parameters, and combinations thereof.

24. The tension system of claim 17 wherein said processor is in electronic communication with said motion imparting mechanism.

25. The tension system of claim 24 further comprising a second encoder in electronic communication with said processor and in mechanical communication with one of the group consisting of said rotatable axial rod, said rotatable disc, said rotatable cam, and combinations thereof for determining the angular position of said rod.

26. The tension system of claim 25 wherein said second encoder electronically communicates the angular position of said one of the group consisting of said rotatable axial rod, said rotatable disc, said rotatable cam, and combinations thereof to said processor and said processor monitors and analyzes said angular position to determine a rotational speed of said one of the group consisting of said cam, said disc, said lifting bar, and combinations thereof.

27. The tension system of claim 24 wherein said motion imparting mechanism comprises a motor and a rotatable threaded screw in operative communication with said weight.

28. The tension system of claim 24 further comprising a first encoder in electronic communication with said processor and in mechanical communication with said motion imparting mechanism for determining the position of said weight relative to said lever mechanism.

29. The tension system of claim 17 wherein said motion imparting mechanism comprises a piston and a rod operatively engaged with a carriage.

30. The tension system of claim 17 wherein said motion imparting mechanism comprises a motor and a rotatable threaded screw operatively engaged with a carriage through a threaded bore in said carriage.

31. The tension system of claim 16 further comprising a carriage associated with said weight, wherein said carriage is operatively engaged with said lever mechanism.

32. The tension system of claim 31 wherein said lever mechanism comprises an enclosed frame having a longitudinal opening along the bottom and a track provided inside said frame on opposite sides of said opening, and said carriage comprises a plurality of rotatable wheels for traveling on said track.

33. The system of claim 16 wherein said processor automatically monitors and automatically adjusts the amount of tension imparted to said lifting bar during use.

34. The tension system of claim 16 further comprising a first rotatable member on a servo motor, and a second rotatable member provided in association with said weight for moving said weight along said lever mechanism, wherein said first and second rotatable members are in communication with each other.

35. A variable tension weight lifting system comprising:

a) a pivotally mounted lever mechanism comprising a track;

b) a weight;

c) a carriage engaged with said weight, wherein said carriage comprises a plurality of rotatable wheels received within said track;

d) a servo motor engaged with a first end of said lever mechanism;

e) a rotatable threaded screw operatively engaged with a rotor of said servo motor, wherein said threaded screw is received within a threaded bore in said carriage;

f) a first cable having a first end engaged with a second end of said lever mechanism;

g) a rotatable disc engaged with a second end of said first cable;

h) a rotatable cam fixedly engaged with said rotatable disc, said cam including a plurality of openings therein;

i) a second cable having a first end engaged with said rotatable cam and a second end operatively engaged with a lifting bar;

j) a processor in communication with said servo motor;

k) a safety latching mechanism including a latch for insertion into one of said openings in said cam, said safety latching mechanism being in electronic communication with said processor;

l) a first encoder in electronic communication with said processor and operatively engaged with said rotor of said servo motor wherein said processor is adapted to operate said servo motor to cause said weight to move to a position with respect to said lever mechanism; and m) a second encoder in electronic communication with said processor and operatively engaged with one of the group of said rotatable axial rod, said rotatable disc, said rotatable cam, and combinations thereof, for reporting the angular position of said rod, wherein said processor analyzes said angular position over time to determine a rotational speed of said one of the group of said rotatable axial rod, said rotatable disc, said rotatable cam, and combinations thereof and is operable to activate said safety latching mechanism to insert said latch into one of said openings in said cam to remove force from said lifting bar exerted by said weight through said second cable.

36. A cable tension system comprising:

a) a pivotally mounted lever mechanism;

b) a weight movably engaged with said lever mechanism;

c) a motion imparting mechanism for moving said weight with respect to said lever mechanism;

d) a first cable having a first end in communication with said lever mechanism at an attachment point, and an opposite end in communication with a rotatable disc attached to a rotatable axial rod;

e) a rotatable cam fixedly engaged with said rotatable disc;

f) a second cable having a first end in communication with said cam, and an opposite end in communication with a lifting bar; and g) a safety ratchet electronically controlled by a processor for preventing tension from being imparted to said lifting bar in an emergency;

wherein tension on said cables between said lever mechanism and said lifting bar corresponds to the position of said weight with respect to said lever mechanism, and wherein said rotatable cam provides even tension to said second cable as said rotatable cam rotates to compensate for movement of the lifting bar and arcuate movement of the lever mechanism.

37. The cable tension system of claim 36 wherein said safety ratchet comprises a plurality of openings on said rotatable cam and a safety latch mechanism for inserting a latch into one of said openings in an emergency.

38. The cable tension system of claim 36 wherein said safety ratchet comprises a plurality of openings on said rotatable disc and a safety latch mechanism for inserting a latch into one of said openings in an emergency.

* * * * *